United States Patent [19]

Kinzel et al.

[11] Patent Number: 5,067,191

[45] Date of Patent: Nov. 26, 1991

[54] BRIDGE LAYER

[75] Inventors: Walter Kinzel, Mainz; Eberhard Illgner, Niederolm, both of Fed. Rep. of Germany

[73] Assignee: MAN Gutehoffnungshütte AG, Oberhausen, Fed. Rep. of Germany

[21] Appl. No.: 466,391

[22] PCT Filed: Nov. 12, 1988

[86] PCT No.: PCT/EP88/01026

§ 371 Date: Apr. 25, 1990

§ 102(e) Date: Apr. 25, 1990

[87] PCT Pub. No.: WO90/05215

PCT Pub. Date: May 17, 1990

[51] Int. Cl.[5] ..... E01D 15/12

[52] U.S. Cl. ..... 14/2.4

[58] Field of Search ..... 14/2.4, 2.6, 71.7, 71.3

[56] References Cited

U.S. PATENT DOCUMENTS

| | | | |
|---|---|---|---|
| 3,488,787 | 1/1970 | Soffge et al. | 14/2.4 |
| 3,491,391 | 1/1970 | Soffge | 14/2.4 |
| 3,492,683 | 2/1990 | Wagner et al. | 14/2.4 |
| 4,023,226 | 5/1977 | Soffge et al. | 14/2.4 |
| 4,510,637 | 4/1985 | Zlotnicki | 14/2.4 |

FOREIGN PATENT DOCUMENTS

| | | | |
|---|---|---|---|
| 1908429 | 9/1970 | Fed. Rep. of Germany . | |
| 1658604 | 6/1971 | Fed. Rep. of Germany . | |
| 2725844 | 12/1978 | Fed. Rep. of Germany | 14/2.4 |
| 2164377 | 3/1986 | United Kingdom . | |

*Primary Examiner*—Stephen J. Novosad
*Attorney, Agent, or Firm*—Max Fogiel

[57] ABSTRACT

A bridge-laying device is placed, together with bridges or bridge sections (26), on an armored tracked vehicle (7) used by the armed forces in various countries, after removal of the armored turret. The laying device is constructed as a unit on a guide support (10) and placed on the annular part (25) of the turret of the vehicle (7), to which it is screwed. The laying device includes laying support (10) hydraulically mobile in the longitudinal direction, a mobile front laying arm (8) and a swivelling rear jib (16). Articulated supporting legs (12) which support the vehicle during the laying operation are also provided. These supporting legs are raised when the bridge-laying vehicle (7) moves.

8 Claims, 3 Drawing Sheets

BRIDGE LAYER

BACKGROUND OF THE INVENTION

The invention concerns a bridge layer with mechanisms for laying stacked bridges or bridge sections.

Bridge layers with mechanisms for laying a bridge consisting of several parts are known. The parts are stacked on the vehicle for transport and are joined together while still on it. They are positioned by an arm on the side of the vehicle and by booms, and an advancing mechanism comprises a variable pinion that engages a ladder rack.

Known bridge layers are either wheeled or tracked vehicles.

The Leguan ("iguana") is a bridge layer with wheels and the Biber ("beaver") a bridge layer with a track.

The armored Biber has an arm with a piston-and-cylinder mechanism at the front and a boom for joining the bridges at the rear of the underturret. These mechanisms are built onto the hull. Built into the front of the vehicle is a telescoping bracing system with a raking blade.

This known armored and tracked bridge layer is accordingly a specialized vehicle that can only be employed for the aforesaid purpose. Another drawback is that, when the vehicle is in the traveling mode, its center of gravity is not in a practical location in that the bridge sections and laying systems project relative far forward from in front, considerably stressing the forward track wheels.

SUMMARY OF THE INVENTION

The object of the present invention is to completely improve the system of mechanisms for laying bridges or bridge sections from an armored and tracked vehicle using the arm and boom known from the Biber to the extent that the center of gravity will be ideal while the vehicle is traveling. Furthermore, the vehicle that is to function as a bridge layer is to be an armored and tracked vehicle that is not specifically designed for laying bridges.

The bridge layer in accordance with the invention consists of a positioning mechanism that can be mounted on the turret ring of a known type of armored vehicle, converting it into a bridge layer. The turret that normally rests on and is bolted to this ring on the vehicle's hull is unnecessary.

The bridge-laying system is advanced approximately one meter into and out of the laying position from a control carriage by a piston-and-cylinder mechanism inside the carriage. Instead of the laying system that is rigidly built onto the hull of the armored bridge layer at the state of the art with its position in relation to the vehicle dictated by the laying kinematics and making the whole structure top-heavy, retracting the laying system and bridge in accordance with the invention out of the laying position and into the traveling position ideally locates the center of gravity for traveling. The angle of inclination increases as the mechanism is displaced, facilitating overland travel.

Instead of the bracing system and scraper built into the front of the Biber armored bridge layer to transmit the supporting forces into the ground while the bridge cantilevers out to the front, the cantilever moment in accordance with the invention is supported on two legs.

The legs are articulated laterally to the front of the carriage and the supporting forces are transmitted by hydraulic piston-and-cylinder mechanisms that rest against the carriage. Since the two cylinders operate independently, they can compensate for longitudinal and transverse irregularities in the ground, allowing unexceptionable bridge laying even on uneven embankments. Plates articulated to the bottom of the legs ensure satisfactory distribution of pressure even on soft soil.

The overall laying system and bridge, resting on the platform on the turret ring of the bridge layer, is designed to minimally restrict the operator's vision while the bridge is being laid and while the bridge layer is traveling. Since the legs have also been pivoted up by the piston-and-cylinder mechanism while the vehicle is traveling, with the plates resting against the front but outside the angle of inclination, the legs also will limit the driver's vision only minimally. One or even two commander's cupolas can be built into the side of the platform and provided with a periscope. The hatch is in the top of the platform.

BRIEF DESCRIPTION OF THE DRAWINGS

One embodiment of the invention will now be described with reference to the drawings, wherein.

DESCRIPTION OF THE PREFERRED EMBODIMENTS

Figure 1:
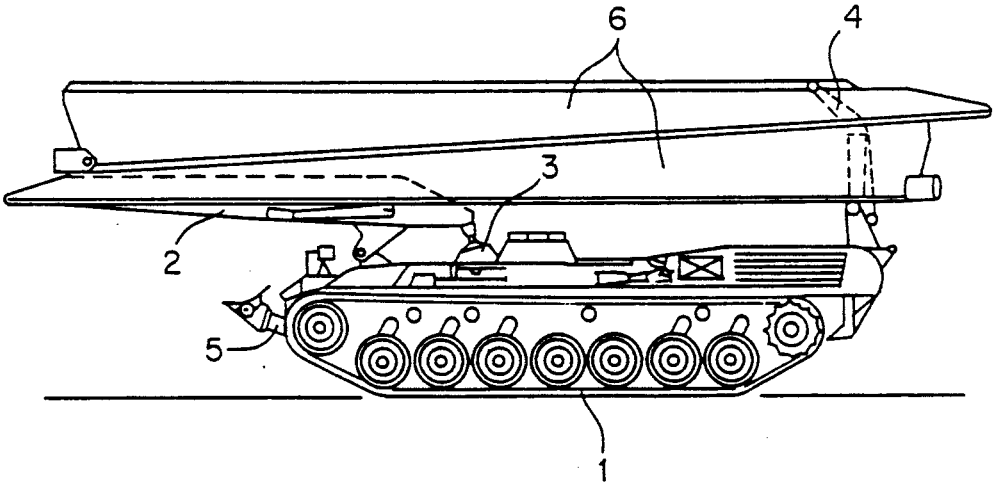
Fig. 1 PRIOR ART
FIG. 1 is a side view of the known Biber armored bridge layer.
Figure 2:
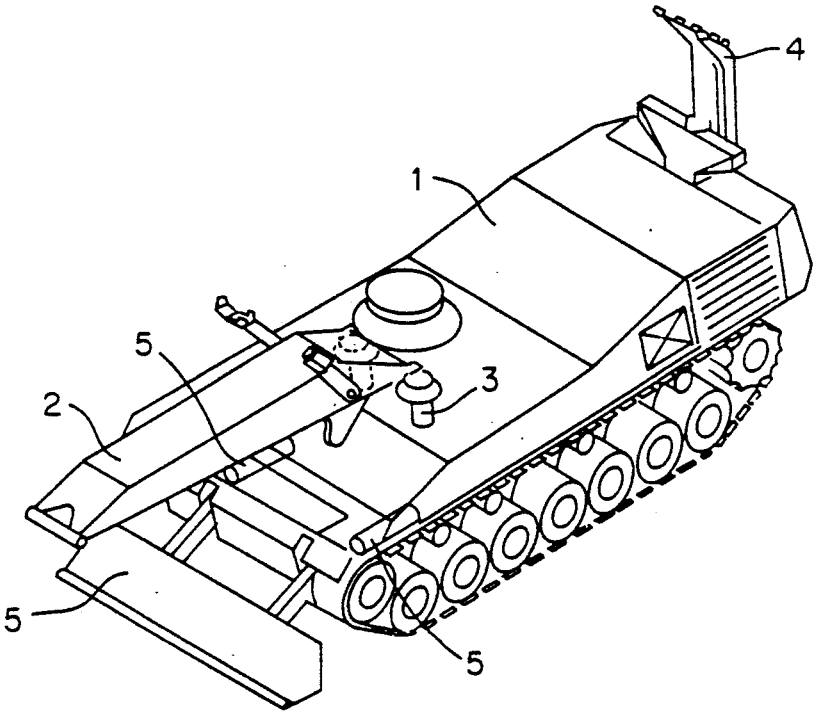
FIG. 2 is a perspective view of the bridge layer in FIG. 1.

FIGS. 1 and 2 illustrate the known Biber armored bridge layer (Soldat und Technik 2 [1976], 62–68). This vehicle is designed as a special vehicle for transporting and laying bridges. The bridge consists of two sections 6 stacked on an armored vehicle 1. The sections are longer than the vehicle. Before being laid, the sections are assembled into a continuous bridge on the vehicle. The laying system comprises a pivoting boom 4, an (unillustrated) advancing mechanism, and a pivoting arm 2 powered by cylinders 3. Boom 4 and arm 2 are mounted on platform on the underturret of vehicle 1.

Built into the front of vehicle 1 is a bracing system 5 with a scraper attached to the front. The bracing system can be raised and lowered and is intended to brace the vehicle while a bridge is being laid.

Figure 3:
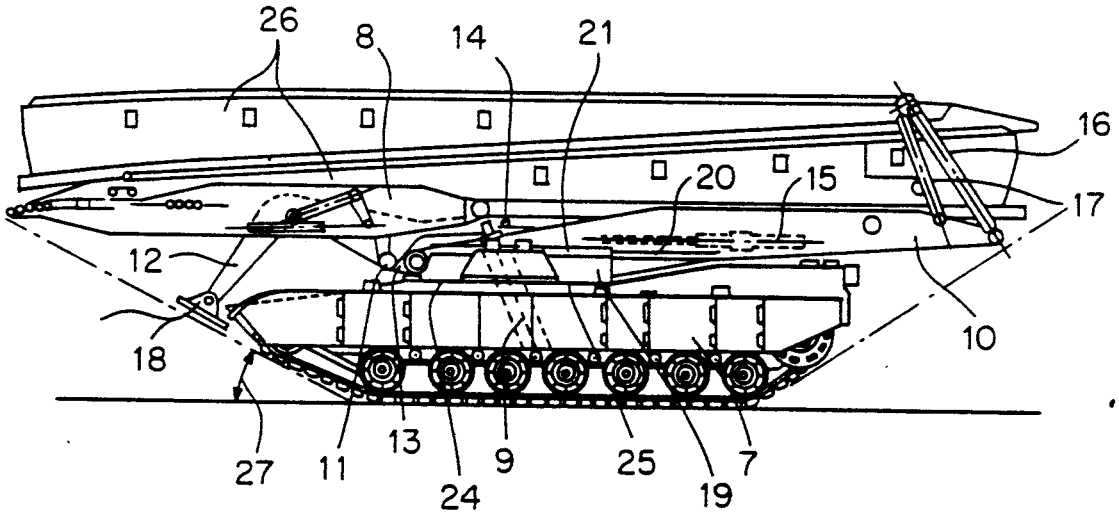
FIG. 3 is a side view of the bridge layer in accordance with the invention in the traveling position.
Figure 4:
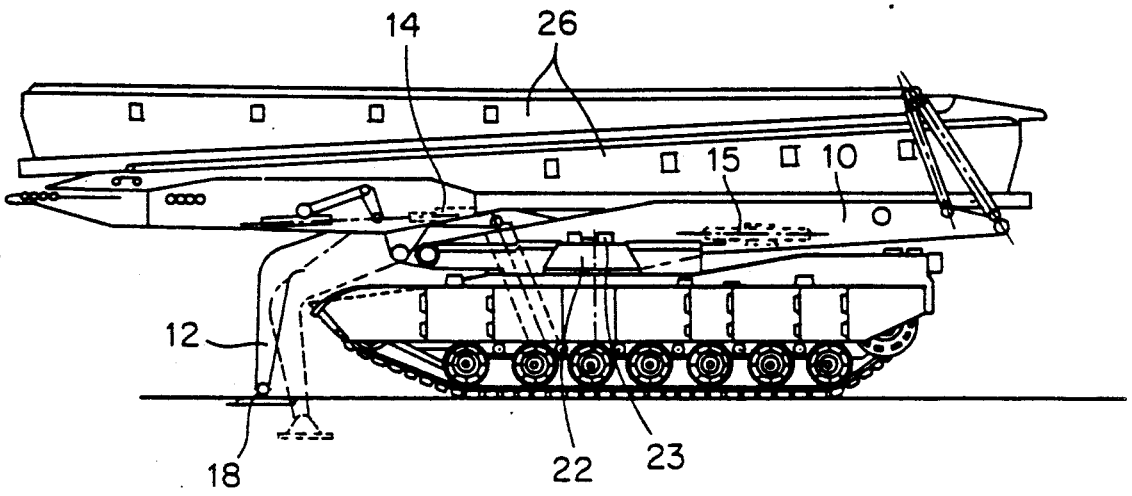
FIG. 4 is a side view of the bridge layer in accordance with the invention in the laying position.
Figure 5:
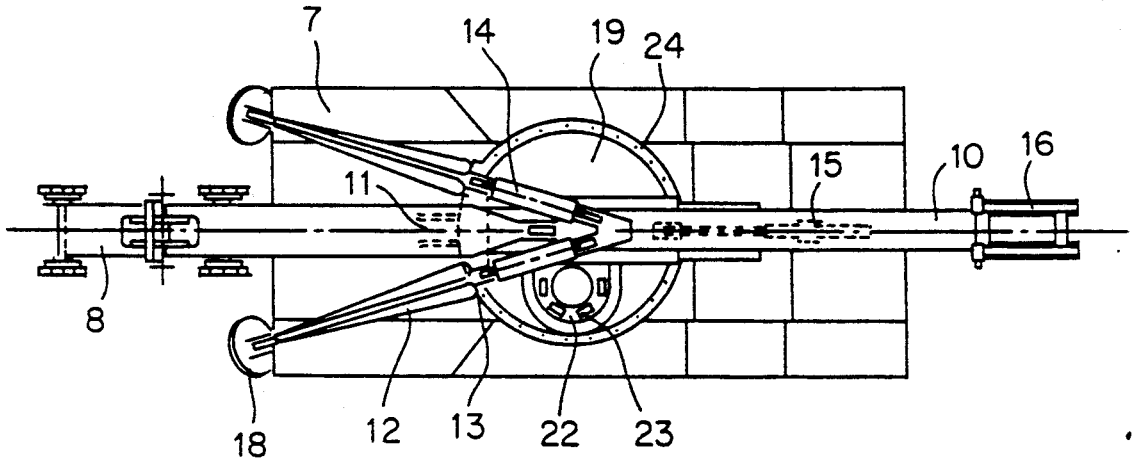
FIG. 5 is a top view of the laying system and vehicle.

The bridge-laying vehicle 7 in accordance with the invention and illustrated in FIGS. 3 and 4 is an armored model that has been employed for years by the armies of various countries. No external modifications have been undertaken in it.

The overall bridge-laying system is mounted on a platform 19, the bottom of which is in the form of a ring 24. Platform 19 is mounted on the turret ring 25 of vehicle 7, and rings 24 and 25 are bolted together.

Figure 6:
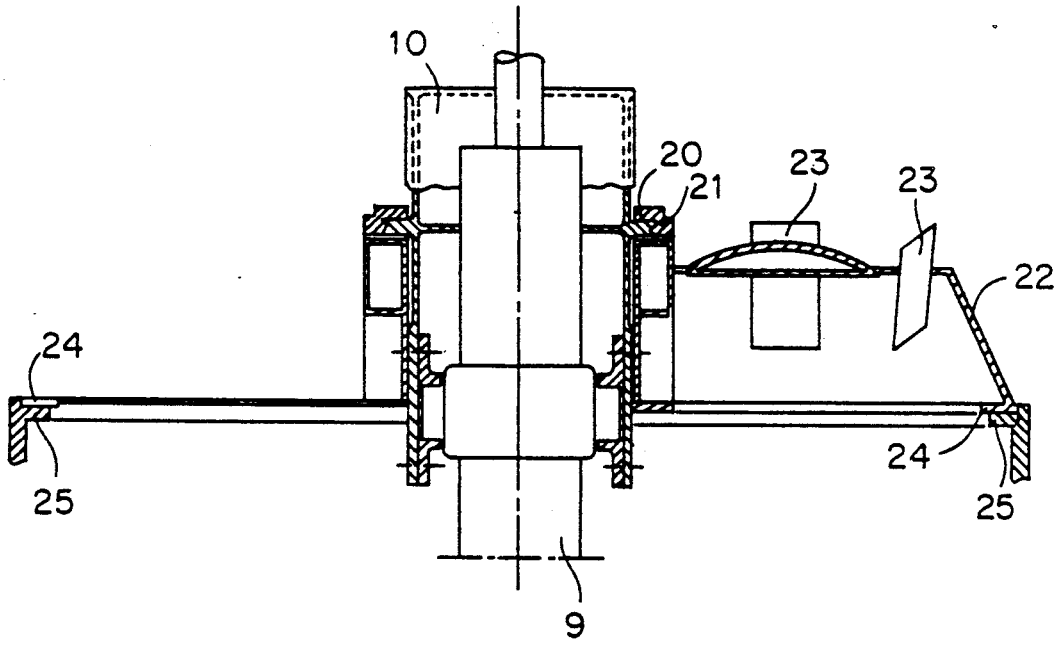
FIG. 6 is a larger-scale section through the laying system across the direction of travel.

A carriage 10 has, as will be evident from FIG. 6, lateral guides 20 that position it in tracks 21 bolted to the platform 19. Carriage 10 is displaced by a piston-and-cylinder mechanism 15.

At the front of carriage 10 is a bearing 11 for bridge-laying arm 8 and another bearing 13 for two legs 12. Arm 8 is activated by a piston-and-cylinder mechanism 9. Legs 12 are activated by piston-and-cylinder mechanisms 14.

Articulated to the ends of legs 12 are plates 18 that the legs rest against while a bridge is being laid on an embankment. The legs can be adjusted to compensate for irregularities in the ground.

Positioned behind carriage 10 are a boom 16 and the piston-and-cylinder mechanism 17 that activates it.

FIG. 3 illustrates vehicle 7 in the traveling position. Bridge sections 26 and the laying system are retracted. Legs 12 are up. The angle 27 of inclination at the front of vehicle 7 is approximately 28° and at the rear approximately 32°.

FIG. 4 illustrates vehicle 7 in the bridge-laying position, with bridge 26 and the laying system advanced approximately one meter forward by the piston-and-cylinder mechanism on carriage 10. Legs 12 rest on plates 18 on the surface of the embankment.

Integrated into one side of carriage 10 is, as will be evident from FIGS. 3 through 6, a commander's cupola 22 with a periscope 23 with replaceable mirrors that provides an unimpeded view both while the vehicle is traveling and while a bridge is being laid. There is a commander's hatch at this point.

We claim:

1. A bridge laying vehicle with laying means for laying stacked bridges or bridge sections, comprising: an armored tracked vehicle having a gun turret ring with gun turret removed, said gun turret being mounted on the ring when not removed therefrom; a movable arm at front of said vehicle and said laying means and having means for advancing bridges or bridge sections; a movable boom at the rear of said laying means and having supporting means; guide means and carriage means for displacing said movable boom back and forth on said guide means; said guide means having a ring for mounting said guide means on said gun turret ring and removing said guide means from said gun turret ring.

2. A bridge laying vehicle with laying means for laying stacked bridges or bridge sections, comprising: an armored tracked vehicle having a gun turret ring with gun turret removed, said gun turret being mounted on the ring when not removed therefrom; a movable arm at front of said vehicle and said laying means and having means for advancing bridges or bridge sections; a movable boom at the rear of said laying means and having supporting means; guide means and carriage means for displacing said movable boom back and forth on said guide means; said guide means having a ring for mounting said guide means on said gun turret ring and removing said guide means from said gun turret ring; guide tracks on top of said guide means for receiving said carriage means in lateral guides; and piston-and-cylinder means for sliding said carriage means back and forth.

3. A bridge layer as defined in claim 1, wherein said movable arm is mounted on said carriage means; and second piston-and-cylinder means for actuating said movable arm.

4. A bridge layer as defined in claim 1, including bearing means at front of said carriage means for said movable arm; said supporting means having a plurality of legs pivoted on said bearing means; each of said legs having a piston-and-cylinder means resting against said carriage means.

5. A bridge layer as defined in claim 4, including plates pivoted on said legs of said supporting means for supporting said legs on ground.

6. A bridge layer as defined in claim 2, including a commander's cupola with viewing means integrated into at least one side of said guide means.

7. A bridge laying vehicle with laying means for laying stacked bridges or bridge sections, comprising: an armored tracked vehicle having a gun turret ring with gun turret removed, said gun turret being mounted on the ring when not removed therefrom; a movable arm at front of said vehicle and said laying means and having means for advancing bridges or bridge sections; a movable boom at the rear of said laying means and having supporting means; guide means and carriage means for displacing said movable boom back and forth on said guide means; said guide means having a ring for mounting said guide means on said gun turret ring and removing said guide means from said gun turret ring; guide tracks on top of said guide means for receiving said carriage means in lateral guides; first piston-and-cylinder means for sliding said carriage means back and forth; bearing means at front of said carriage means; said supporting means having legs pivoted on said bearing means; each of said legs having piston-and-cylinder means resting against said carriage means; second piston-and-cylinder means for actuating said movable arm; plates pivoted on said legs of said supporting means for supporting said legs on ground.

8. A bridge layer as defined in claim 7, including pulling means on an end of said movable arm; two roller means, said pulling means pulling a lower part of said bridge over said two roller means in said guide tracks towards the front of said vehicle unit a high end of said bridge attains an end position substantially over said support legs; said bridge having an upper part moved in a direction opposite to movement of said lower part immediately after said lower part is moved by said movable boom and lowered after attaining an end position; means for securing two parts of said bridge together after movements of said lower part and said upper part; said pulling means shifting said parts secured together horizontally to said end of said movable arm and to an end position where said movable arm with said bridge is lowered by said second piston-and-cylinder means.

* * * * *